US005356021A

United States Patent [19]

McBride et al.

[11] Patent Number: 5,356,021

[45] Date of Patent: Oct. 18, 1994

[54] CONTAINER CLOSURE WITH MULTIPLE LINER SEALS

[75] Inventors: Stephen W. McBride, Brownsburg; Lawrence M. Smeyak, Lafayette, both of Ind.

[73] Assignee: H-C Industries, Inc., Crawfordsville, Ind.

[21] Appl. No.: 129,262

[22] Filed: Sep. 30, 1993

[51] Int. Cl.[5] ..... B65D 53/00

[52] U.S. Cl. ..... 215/349; 215/350; 215/351

[58] Field of Search ..... 215/348, 349, 350, 351, 215/347, 352, 232, 341, 344; 220/304

[56] References Cited

U.S. PATENT DOCUMENTS

| | | | |
|---|---|---|---|
| 681,132 | 8/1901 | Norton . | |
| 1,755,168 | 4/1930 | Carvalho . | |
| 2,465,662 | 3/1949 | Sanford . | |
| 3,443,771 | 5/1969 | Olson . | |
| 3,958,710 | 5/1976 | Harding et al. . | |
| 4,497,765 | 2/1985 | Wilde et al. . | |
| 4,531,649 | 7/1985 | Shull | 215/232 |
| 4,658,976 | 4/1987 | Pohlenz . | |
| 4,747,500 | 5/1988 | Gach et al. . | |
| 5,004,112 | 4/1991 | McBride . | |
| 5,050,753 | 9/1991 | Trump et al. . | |
| 5,062,538 | 11/1991 | Ochs . | |
| 5,121,845 | 6/1992 | Blanchard . | |
| 5,188,628 | 2/1993 | Rani et al. | 604/405 |

FOREIGN PATENT DOCUMENTS

0488985A1 11/1991 European Pat. Off. .

*Primary Examiner*—Allan N. Shoap
*Assistant Examiner*—Nova Stucker
*Attorney, Agent, or Firm*—Dressler, Goldsmith, Shore, Sutker & Milnamow, Ltd.

[57] ABSTRACT

A container closure having a multiple liner seal is disclosed. The closure comprises a plastic closure cap having a circular top wall portion and a depending annular skirt portion. The skirt portion has an internal thread formation for threadedly engaging a cooperative container. In a typical closure, a pilfer band depends from the skirt portion. The closure cap has an abutment internal thereto, generally at the juncture of the top wall portion and the skirt portion. A first resilient, molded-in plastic seal is positioned in the cap adjacent to and against the top wall portion, and a second resilient plastic seal is positioned in the closure and extends thereacross resting upon the abutment. When the closure is threadedly engaged with a container, the second seal provides a top/side seal to seal the contents from the environs. The closure will seal a container with or without the second seal in place because of the independent sealing capabilities of the first seal.

4 Claims, 2 Drawing Sheets

CONTAINER CLOSURE WITH MULTIPLE LINER SEALS

FIELD OF THE INVENTION

The present invention relates to closures for containers and more particularly to closures for containers which include multiple liner seals.

BACKGROUND OF THE INVENTION

Various types of closures and closure seals for containers such as bottles or the like are known in the art. One of the most widely used type of closure is comprised of a plastic closure cap with a deformable plastic liner formed or positioned therein, as disclosed in U.S. Pat. No. 4,658,976 to Pohlenz, entitled "Lined Plastic Closure." The liners currently known in the art function well to provide an effective seal for the container contents such as carbonated beverages. However, because the container may be resealed numerous times, therein lies the opportunity for a liner to be removed or inadvertently fall out, leaving the closure without a seal. It has also been observed that some soft drink manufacturers and bottlers have made use of seals for novelty and sales promotions, vis-a-vis redemption of the seals for cash or awards. In these instances, if the seal is removed from the closure before the container is emptied, the closure cannot function to properly seal the contents of the container.

Accordingly, a container closure is disclosed which has multiple liner seals to seal the container, but which effectively seals a container with only one liner in place therein.

SUMMARY OF THE INVENTION

In accordance with the present invention, a container closure is disclosed which includes a plastic closure cap having multiple liners or seal elements positioned therein to effectuate a seal between the contents of the container and the environs. In a typical embodiment, the closure cap includes a pilfer band to provide evidence that the closure has been partially or completely removed from the container. The closure cap has a circular top wall portion and a depending annular skirt portion. The skirt portion has internal threads formed thereon for engaging an associated container. The cap has an annular abutment generally at the juncture of the top wall portion and the skirt portion.

The first seal element is positioned in the closure cap adjacent to and in contact with the inner surface of the top wall portion and extends fully across the cap. The first seal element is of the molded-in type. The second seal element is positioned adjacent to the first seal element and rests across the surfaces of the annular abutment. The second seal element is of the inserted disk type. The seals are preferably fabricated from a resilient material such as ethyl vinyl acetate (EVA) polyethylene suitable for working and deformation by the interaction of the cap and container.

In the first illustrated embodiment, the annular abutment comprises a shoulder having substantially flat horizontal and vertical surfaces. The first seal is positioned in the closure between the vertical surfaces. The second seal rests on the horizontal surfaces and extends thereacross.

In use, in the initial application, a closure is threaded onto the mouth of a container. As the mouth of the container contacts the second seal, the seal becomes pinched or sandwiched between the abutment and the container. This pinching action effectuates a top/side seal of the container which forms to the container finish. When used in the initial application, the first seal serves to cushion the second seal, thus providing even greater assurance of proper sealing of the container.

Upon subsequent applications of the closure to the container, the second seal may not be in place due to inadvertent dislodging or purposeful removal. In these instances, the first seal provides the primary seal for the container.

Notably, the present invention provides a closure cap whereby the second seal may be used as a promotional device for bottlers and manufacturers which can be removed and redeemed while the cap maintains the capability to properly seal the container contents from the environs.

In a second embodiment, the annular abutment comprises an inwardly extending lip which defines an annular recess between the lip and the top wall portion. The first seal of this embodiment is of the molded-in type and comprises a circumferential bead portion and a central portion. The bead portion is at least partially disposed in the annular abutment and the central portion extends across the inner surface of the closure cap.

Other embodiments are disclosed which vary in details with respect to the abutment and first seal configuration, but which are within the scope and spirit of the present invention.

Other features and advantages of the present invention will be apparent from the following detailed description, the accompanying drawings and the appended claims.

DETAILED DESCRIPTION OF PREFERRED EMBODIMENTS

Figure 1:
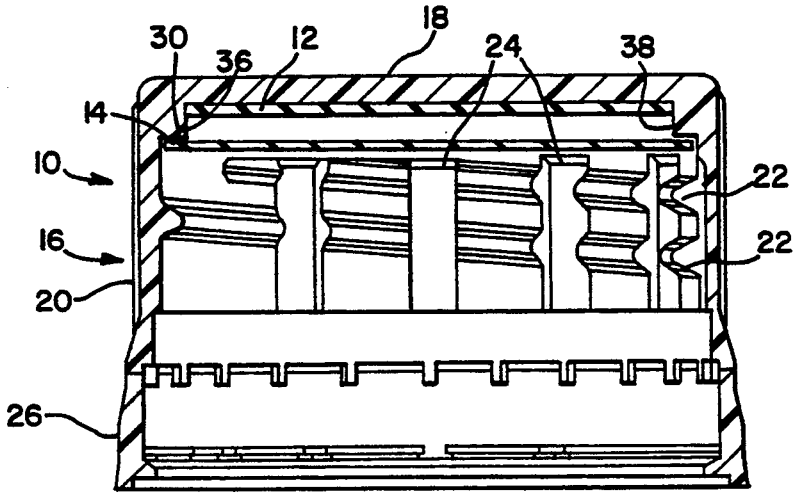
FIG. 1 is a cross-sectional side view of an exemplary closure cap and multiple liner seals embodying the principles of the present invention.

While the present invention is susceptible of embodiment in various forms, there is shown in the drawings and will hereinafter be described a presently preferred embodiment with the understanding that the present disclosure is to be considered an exemplification of the invention and is not intended to limit the invention to the specific embodiments illustrated.

With reference now to the drawings, therein is illustrated an exemplary plastic closure 10 with first and second seal elements 12, 14 positioned therein and which embodies the principles of the present invention. As illustrated, closure 10 is generally cup shaped and includes a closure cap 16 having a circular top wall portion 18 and a depending annular skirt portion 20.

As best seen in FIG. 1, skirt portion 20 has an internal thread formation 22 on the inside surface thereof for threadedly engaging a cooperative container C to which closure 10 is fitted. Vent grooves 24 which extend axially along the skirt portion 20 traverse thread formation 22 to facilitate the release and venting of gas pressure when closure 10 is used with a container C to store carbonated beverages or the like. In a preferred embodiment, closure 10 is formed with a pilfer band 26 to provide visible discernable evidence that closure 10 has been partially or completely removed from the associated container C. The closure cap 16 and associated pilfer band 26 are as described and disclosed in U.S. Pat. No. 5,004,112 to McBride, entitled "Tamper-Indicating Plastic Closure," the teachings of which are herein incorporated by reference.

To effectuate a seal between the contents of container C and the environs, closure 10 includes a first resilient seal element 12 and a second resilient seal element 14. First seal 12 is positioned within closure 10 adjacent to, and in contact with, the inner surface 28 of top wall portion 18. First seal 12 is generally not removable from closure 10 during ordinary use of the closure. However, it may inadvertently dislodge, or may be removed by an individual who so desires. Various methods of forming or inserting first seal 12 into closure 10 are known in the art. It is presently contemplated that a molded-in liner will be used to form first seal 12.

In a preferred construction, closure 10 is formed with an annular abutment 30 generally at the juncture of the top wall portion 18 and skirt portion 20. In the illustrated embodiment, as shown in FIGS. 1–5, abutment 30 is shown as an annular shoulder formed in the inner portion 32 of closure 10 at the juncture of the top wall 18 and skirt portion 20. Shoulder 30 has a substantially horizontal surface 34 and a substantially vertical surface 36, the juncture of which forms a corner 38. Vertical surface 36 defines an inside diameter thereacross. First seal 12 is formed within closure 1 0, and extends radially outward to vertical surface 36.

Figure 2:
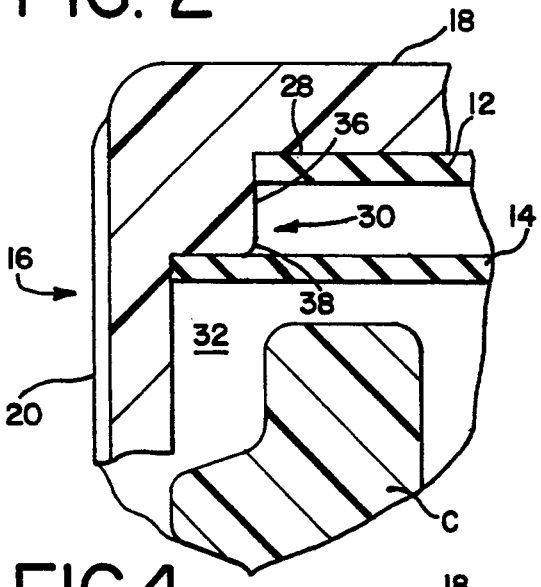
FIG. 2 is a partial cross-sectional view of the present closure cap and multiple liner seals and an associated container, shown prior to initial application of the closure to the container.

Second resilient seal element 14 is positioned within closure 10 adjacent to and separable from first seal 12. In the embodiment shown in FIGS. 1–5, second seal 14 is an inserted disk liner. As best seen in FIG. 2, second seal 14 is inserted into closure 10 and extends radially outward onto horizontal surface 34. As such, the diameter of seal 14 is somewhat greater than the inside diameter across the vertical surfaces of shoulder 30. Seal 14 may extend outward as far as skirt portion 20.

Figure 3:
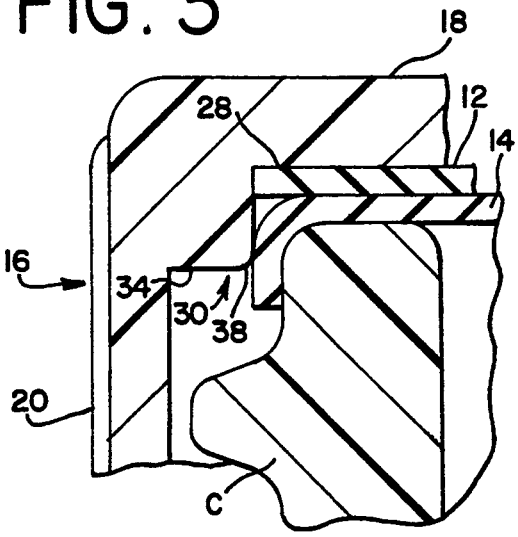
FIG. 3 shows the arrangement of FIG. 2 with the closure fully threaded onto the container.

In the initial application of closure 10 to container C, as best illustrated in FIG. 3, the closure is applied to container C and threadedly engaged until it is firmly seated thereon. Seal 14 creates a top/side seal between container C and closure 10. When closure 10 is fully seated on container C, seal 14 is pinched or squeezed between the container C and shoulder 30, wherein seal 14 forms to the container finish. In addition, in the initial application of closure 10 to container C and in subsequent applications in which both seals 12, 14 are in place, first seal 12 serves to cushion the seal provided by second seal 14. This is helpful in instances where, for example, the irregularities of the container finish require an additional resilient surface to effectuate a proper seal of the container C.

During the initial stage of deforming seal 12, the seal is drawn downward along the mouth of the container C along its marginal edge by the axial movement of closure 10 relative to the container C. As the closure 10 is progressively screwed onto container C, liner 14 becomes pinched or squeezed between corner 38 and the mouth of container C. As illustrated in FIG. 3, with closure 10 fully threaded onto container C, seal 14 is deformed from its initial flat state, and conforms to a shape which results from the coacting of shoulder 30 and the mouth of container C. This conforming action effectuates a top/side seal of the container.

Figure 4:
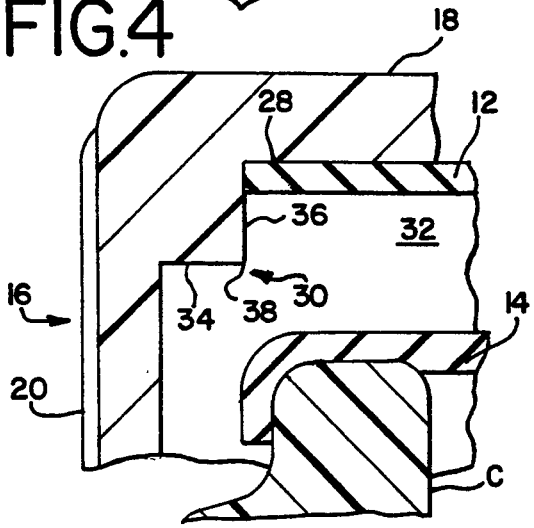
FIG. 4 shows the arrangement of FIG. 3 upon removal of the closure from the container, and with the second seal remaining on the container.
Figure 5:
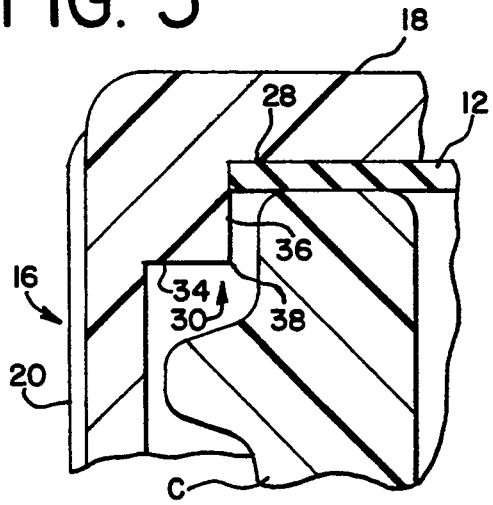
FIG. 5 shows the engagement of a closure cap on an associated container with the second seal removed from the cap.

Subsequently, as illustrated in FIG. 4, upon removal of closure 10 from the container C, seal 14 may dislodge from closure 10 and either remain on container C, or simply fall out. With the closures known in the art prior to the present invention, this would result in an almost complete loss of sealing capability of the closure. However, in the present invention, as illustrated in FIG. 5, first seal 12 provides an independent sealing capability for closure 10.

In these subsequent applications of closure 10 to container C, second seal 14 may have been removed either inadvertently or purposefully for such reasons as use as a sweepstakes entry token or redemption for cash or awards from manufacturers or bottlers. In use with seal 14 removed, as closure 10 is progressively threaded onto container C, the mouth of container C contacts first seal 12 which is adjacent to inner surface 28. As the closure 10 is further threaded onto container C, seal 12 becomes pinched or squeezed between inner surface 38 and mouth of container C. This pinching action effectuates a seal between the contents of container C and the environs.

The seals 12, 14 can be formed from an ethyl vinyl acetate (EVA) polyethylene material. However, other plastic materials can be employed. Such materials and their properties are as disclosed in the aforementioned U.S. Pat. No. 4,658,976 to Pohlenz. It is additionally contemplated that a multi-layer material can be used for the second seal 14.

Figure 6:
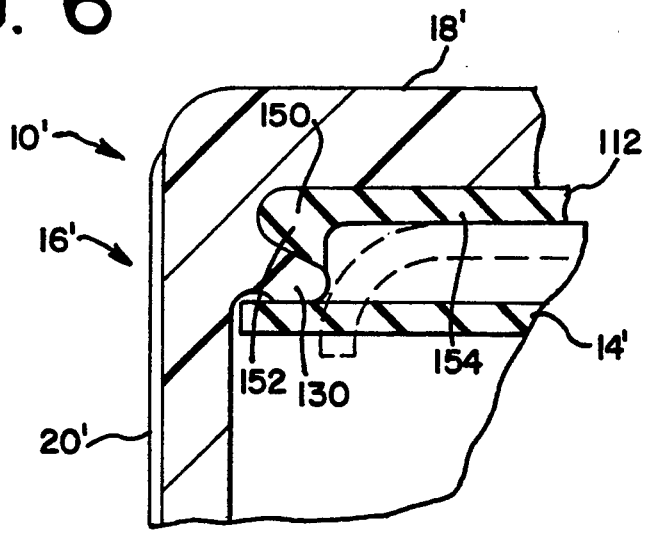
FIG. 6 is a partial cross-sectional view of an alternative embodiment of the closure cap of the present invention, shown prior to initial application of the closure to a container, and showing, in broken lines, the deformation of the second seal upon application of the closure to a container.
Figure 7:
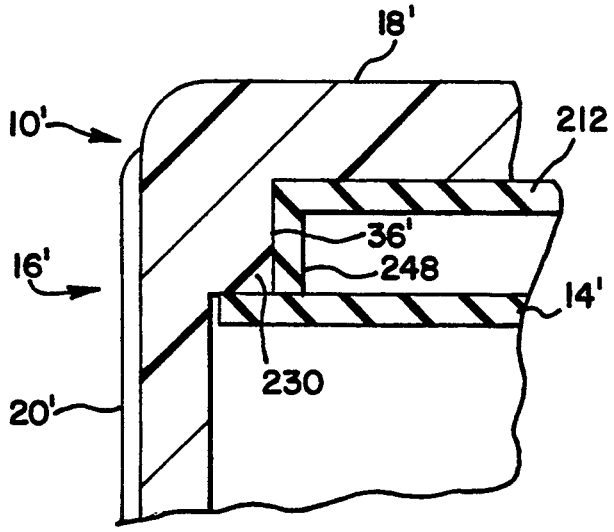
FIG. 7 is a partial cross-sectional view similar to FIG. 6, showing another embodiment of the present invention.
Figure 8:
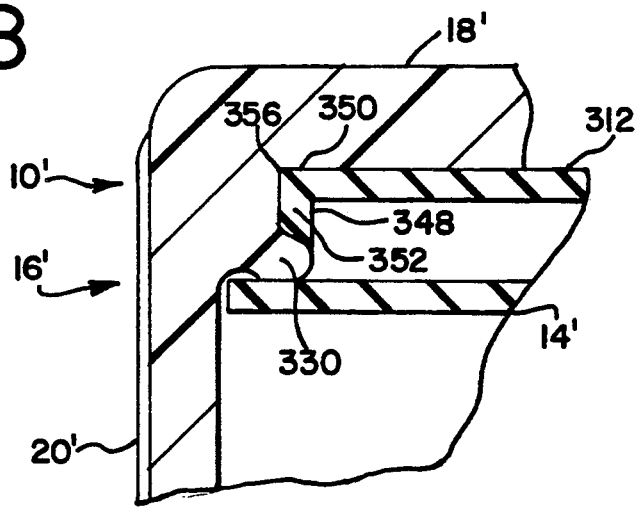
FIG. 8 is a partial cross-sectional view similar to FIG. 7, showing yet another embodiment of the present invention.

Alternative embodiments of the present invention are shown in FIGS. 6–8 wherein the exemplary enclosures are shown in assembled fashion with the seals positioned therein and prior to initial application of the closure to a container. With reference to the embodiments shown in FIGS. 6–8, closure 10' is similar to closure 10 and elements designated by primed numbers in FIGS. 6–8 correspond to like elements designated by the same unprimed elements in FIGS. 1–5.

With reference now to FIG. 6, there is shown an alternative embodiment of a plastic closure 10' with first and second seal elements 112, 14' positioned therein and which embodies the principles of the present invention. The closure 10' has a circular top wall portion 18' and a depending annular skirt portion 20'. An annular abutment 130 is formed as a lip, and is generally at the juncture of the top wall portion 18' and skirt portion 20'. The lip 130 extends inwardly of the skirt portion 20' and defines an annular recess 150 between lip 130 and top wall portion 18'. Lip 130 can be formed as a continuous lip or can be formed as segments with gaps (not shown) therebetween.

In a preferred construction of this embodiment, first seal 112 is a molded-in seal having a bead portion 152 at least partially disposed in annular recess 150 and a central portion 154, which constitutes the diaphragm like portion thereof. Second seal 14' is disposed in closure 10' adjacent first seal 112 and extends across closure 10' and rests upon lip 130. In use, this embodiment performs similar to the embodiment illustrated in FIGS. 1–5, such that when the closure is threadedly engaged with the mouth of container C, second seal 14' is drawn across lip 130 and pinched or squeezed therebetween. This pinching action effectuates a top/side seal between closure 10' and container C. And, in similar fashion to the first embodiment, in a subsequent application of closure 10' to container C with second seal 14' removed, first seal 112 provides the primary seal between the contents of container C and the environs.

Another embodiment of the present invention, as illustrated in FIG. 7 includes a molded-in first seal 212 in a similar fashion to the embodiment shown in FIGS. 1–5, however seal 212 has a vertically extending annular rim 248 which lies adjacent to vertical annular surface 36'.

In yet another embodiment of the present invention, as illustrated in FIG. 8, which includes a molded-in seal 312 which is formed in a fashion similar to the embodiment shown in FIG. 6, the annular recess 350 is formed with a corner 356. The bead portion 352 of the first seal 312 is formed with a rim 348 which lies adjacent to the underside of lip 330. The embodiment illustrated in FIG. 8 functions in much the same way as the earlier discussed embodiments, wherein a top/side seal is effectuated by pinching or squeezing of seal 14' due to the coacting of container C and lip 330.

From the foregoing it will be observed that numerous modifications and variations can be effectuated without departing from the true spirit and scope of the novel concept of the present invention. It is to be understood that no limitation with respect to the specific embodiments illustrated is intended or should be inferred. The disclosure is intended to cover by the appended claims all such modifications as fall within the scope of the claims.

What is claimed:

1. A multiple seal closure for a container, comprising:

a plastic closure cap having an imperforate circular top wall portion, and a depending annular skirt portion depending from said top wall portion and having an internal thread formation thereon for engagement with a like thread formation on the container, said closure cap including a continuous annular abutment generally at the juncture of said top wall portion and said skirt portion;

a molded-in first circular, resilient seal element positioned within said plastic cap adjacent to said top wall portion; and a second circular, resilient seal element positioned by insertion within said plastic cap adjacent to and separable from said first seal element, so that upon an initial application to the container, said second seal element effects sealing of said container, with said first sealing element being configured for effecting sealing of the container upon a subsequent application of said closure in the event said second seal element is removed from said plastic cap, said second sealing element comprising a disk having an outside diameter greater than an inside diameter of said annular abutment so that when said closure is applied to the container, said second sealing element cooperatively engages said annular abutment to deform said second sealing element from an initially generally flat state and to conform said second sealing element about the container to form a top/side seal of the container.

2. A multiple seal closure in accordance with claim 1 wherein said abutment comprises a lip extending inwardly of said closure cap to define an annular recess adjacent to said top wall portion, and wherein said first seal element includes a central portion and an annular bead portion at least partially disposed in said annular recess.

3. A multiple seal closure in accordance with claim 1 wherein said abutment comprises an annular shoulder which defines an inside diameter thereacross, said inside diameter being substantially equal to the outside diameter of said first seal element, and the diameter of said second seal element being greater than the inside diameter defined by said abutment.

4. A multiple seal closure for a container, comprising:

a plastic closure cap having an imperforate circular top wall portion, and a depending annular skirt portion depending from said top wall portion and having an internal thread formation thereon for engagement with a like thread formation on the container and having a continuous annular lip generally at the juncture of said top wall portion and said skirt portion, said lip extending inwardly of said closure cap to define an annular recess adjacent to said top wall portion;

a first circular, resilient, molded-in seal element positioned within said plastic cap adjacent to said top wall portion, said first seal element having a central portion and an annular bead portion at least partially disposed in said annular recess; and a second circular, resilient seal element positioned by insertion within said plastic cap adjacent to and separable from said first seal element, so that upon an initial application to the container, said second seal element effects sealing of said container, with said first sealing element being configured for effecting sealing of the container upon a subsequent application of said closure in the event said second seal element is removed from said plastic cap, said second sealing element comprising a disk having an outside diameter greater than an inside diameter of said annular abutment so that when said closure is applied to the container, said second sealing element cooperatively engages said annular lip to deform said second sealing element from an initially generally flat state and to conform said second sealing element about the container to form a top/side seal of the container.

* * * * *